US005125701A

United States Patent [19]

Hayakawa et al.

[11] Patent Number: 5,125,701

[45] Date of Patent: Jun. 30, 1992

[54] CHILD PROTECTING MECHANISM IN DOOR LOCK APPARATUS

[75] Inventors: Shigeru Hayakawa, Chiryu; Soichiro Okudaira, Toyota, both of Japan

[73] Assignees: Aisin Seiki Kabushiki Kaisha, Kariya; Toyota Jidosha Kabushiki Kaisha, Toyota, both of Japan

[21] Appl. No.: 563,155

[22] Filed: Aug. 6, 1990

[30] Foreign Application Priority Data

Aug. 7, 1989 [JP] Japan ..... 1-92820

[51] Int. Cl.[5] ..... E05B 3/00

[52] U.S. Cl. ..... 292/336.3; 292/DIG. 65

[58] Field of Search ..... 292/336.3, 216, 347, 292/DIG. 65, 1

[56] References Cited

U.S. PATENT DOCUMENTS 3,596,482 8/1971 Pollak ..... 292/216 X
4,900,074 2/1990 Kleefeldt et al. ..... 292/216
4,969,673 11/1990 Portelli et al. ..... 292/DIG. 65 X

FOREIGN PATENT DOCUMENTS 55-49403 11/1980 Japan .
61-108463 7/1986 Japan .

*Primary Examiner*—Richard E. Moore
*Attorney, Agent, or Firm*—Finnegan, Henderson, Farabow, Garrett and Dunner

[57] ABSTRACT

A child protecting mechanism for a door lock apparatus of an automotive vehicle is installed in a door panel formed to have an opening. The mechanism includes an operating device disposed in the opening in operative association with a child protecting lever and adapted to be rotated with respect to the door panel to operate the child protecting lever.

6 Claims, 6 Drawing Sheets

CHILD PROTECTING MECHANISM IN DOOR LOCK APPARATUS

BACKGROUND OF THE INVENTION

This invention relates to a child protecting mechanism provided in a door lock apparatus for an automotive vehicle.

A known child protecting mechanism of this kind is as disclosed in the specification of Japanese Utility Model Application Laid-Open (KOKAI) No. 61-108463. This prior-art child protecting mechanism, which is installed inside a door panel of the vehicle, has a child protecting lever formed to include a manipulating portion as an integral part thereof. The manipulating portion protrudes to the exterior of the door panel from an opening formed in the door panel. The child protecting lever is operated by moving the manipulating portion linearly back and forth with respect to the door panel within the opening.

This conventional child protecting mechanism involves certain shortcomings. Specifically, since the child protecting lever is operated by moving the manipulating portion linearly back and forth with respect to the door panel within the opening, as mentioned above, enough space to allow the linear back-and-forth motion of the manipulating portion within the opening must be provided, and therefore the opening cannot be sealed. As a result, water droplets, dust, foul odors and cold or hot air penetrate the interior of the passenger compartment and subject the occupants of the vehicle to discomfort. In addition, since the interior of the door can be seen from the opening, this detracts from the appearance of the vehicle.

SUMMARY OF THE INVENTION

Accordingly, an object of the present invention is to provide a door lock child protecting mechanism in which the aforementioned opening can be sealed.

According to the present invention, the foregoing object is attained by providing a child protecting mechanism in a door lock apparatus provided in a door panel having an opening, comprising a child protecting lever, and operating means disposed in the opening in operative association with the child protecting lever for operating the child protecting lever by being rotated relative to the door panel.

Since the operating means is rotated with respect to the door panel to operate the child protecting lever, it is unnecessary for the opening to provided with space for movement of the operating device. This makes it possible to seal the opening.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An embodiment of the present invention will now be described in detail with reference to the accompanying drawings.

A door lock apparatus having a child protecting mechanism will now be described with reference to FIGS. 1 and 2.

Figure 1:
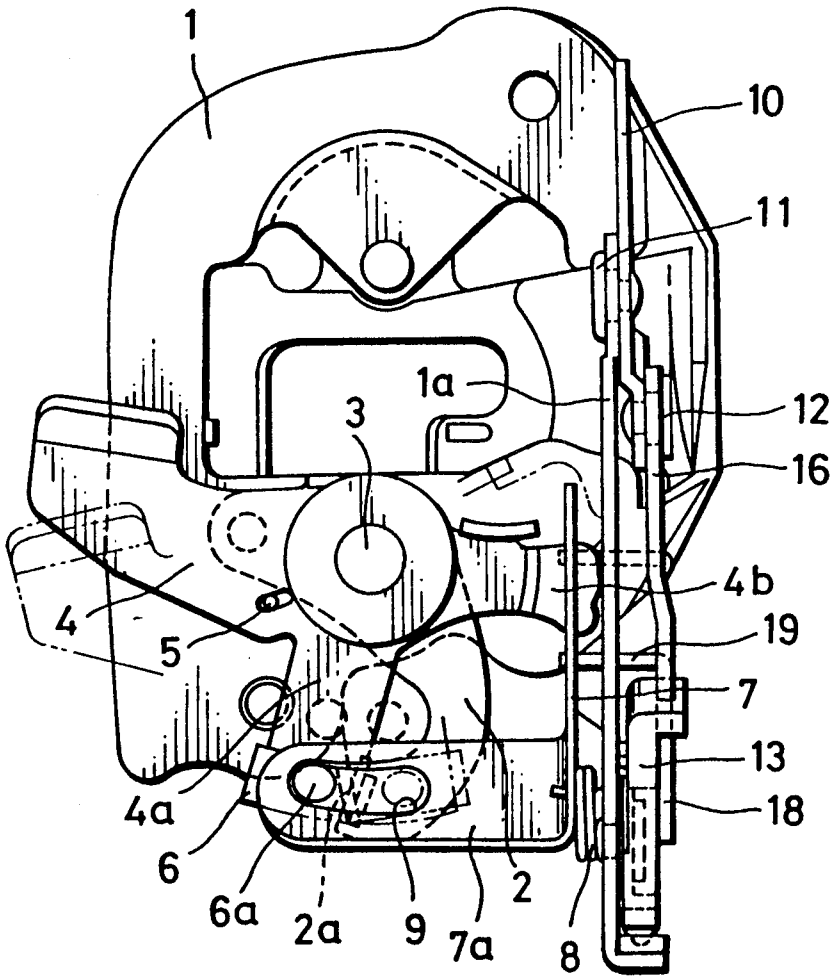
FIG. 1 is a plan view showing a door lock apparatus.

As shown in FIG. 1, a lift lever 2 for actuating an opening/closing mechanism (not shown) is pivotally supported by a pivot pin 3 on a base 1 internally accommodating the opening/closing mechanism, which comprises a pawl and a latch. An opening lever 4 is pivotally supported on the pivot pin 3 and is urged clockwise in FIG. 1 at all times by a spring 5. A slide member 6 having a pin 6*a* erected thereon is slidably retained on one end 4*a* of the opening lever 4. The pin 6*a* is capable of being engaged with one end 2*a* of the lift lever 2. A locking lever 7 connected to a locking knob (not shown) is pivotally supported by a spring 8 on an upstanding portion la of the base 1 so as to capable of turning to a limited extent. One end 7*a* of the locking lever 7 is formed to include an oblong hole 9 defining a circular arc whose center is the pivot pin 3. The pin 6*a* is mated with the oblong hole 9.

Figure 2:
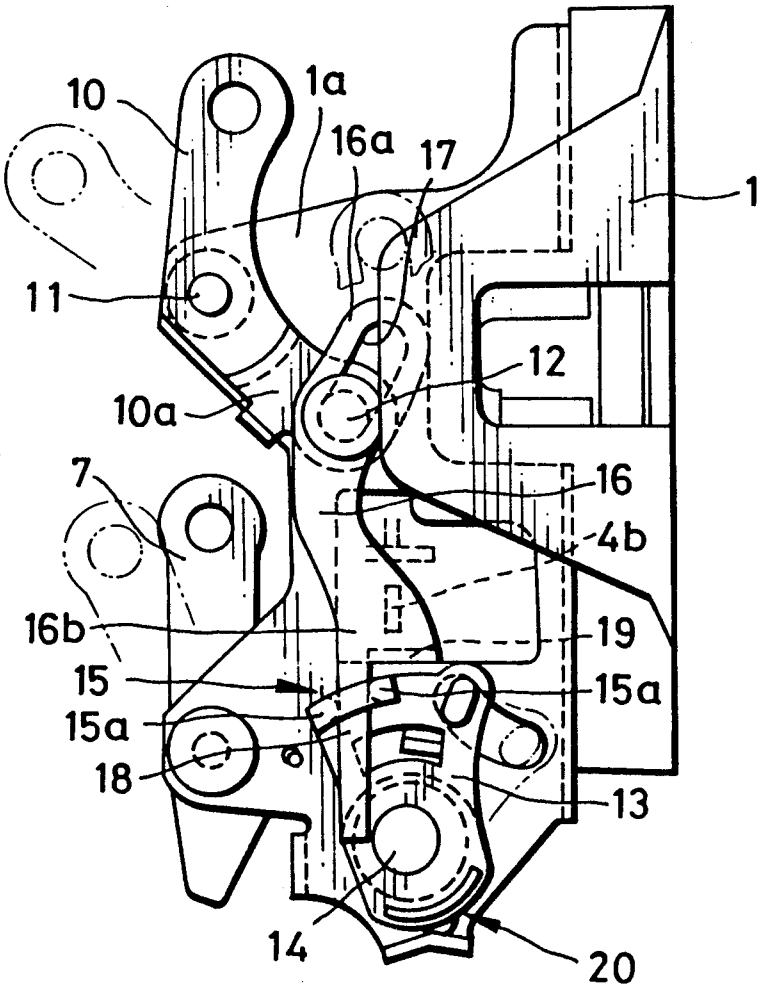
FIG. 2 is a side view of the apparatus shown in FIG. 1.

As shown in FIGS. 1 and 2, an inside lever 10 connected to an inside handle (not shown) is pivotally supported by a pivot pin 11 on the upstanding portion 1*a* on the upper side of the vehicle (the upper side in FIG. 2). A pin 12 is implanted in one end 10*a* of the inside lever 10. A child protecting lever 13 is pivotally supported by a pivot pin 14 on the upstanding portion 1*a* on the lower side of the vehicle (the lower side in FIG. 2). The child protecting lever 13 is formed to have a holding portion 15 comprising two projections 15*a*. Further, the child protecting lever 13 is formed to have a moderating portion 20 which engages with the upstanding portion la to moderate the rotation of the child protecting lever 13 by means of spring action. An opening lift lever 16 is disposed between the inside lever 10 and the child protecting lever 13. One end 16*a* of the opening lift lever 16 is formed to have an oblong hole 17 defining a circular arc whose center is the pivot pin 11. The pin 12 is mated with the oblong hole 17. The latter is utilized for initial play when the inside lever 10 is manipulated. In a case where it is unnecessary to set play, the oblong hole 17 may be dispensed with and the pin 12 may be connected directly to the opening lift lever 16. Further, another end 16*b* of the opening lift lever 16 is formed to have a connecting portion 18 which is engaged with the holding portion 15 by being embraced by the projections 15*a*. The opening lift lever 16 is formed to have an engaging portion 19 capable of engaging with the other end 4*b* of the opening lever 4. It is possible to adopt an arrangement in which the engaging portion 15 is replaced by an oblong hole.

The operation of the apparatus will now be described.

Figure 4:
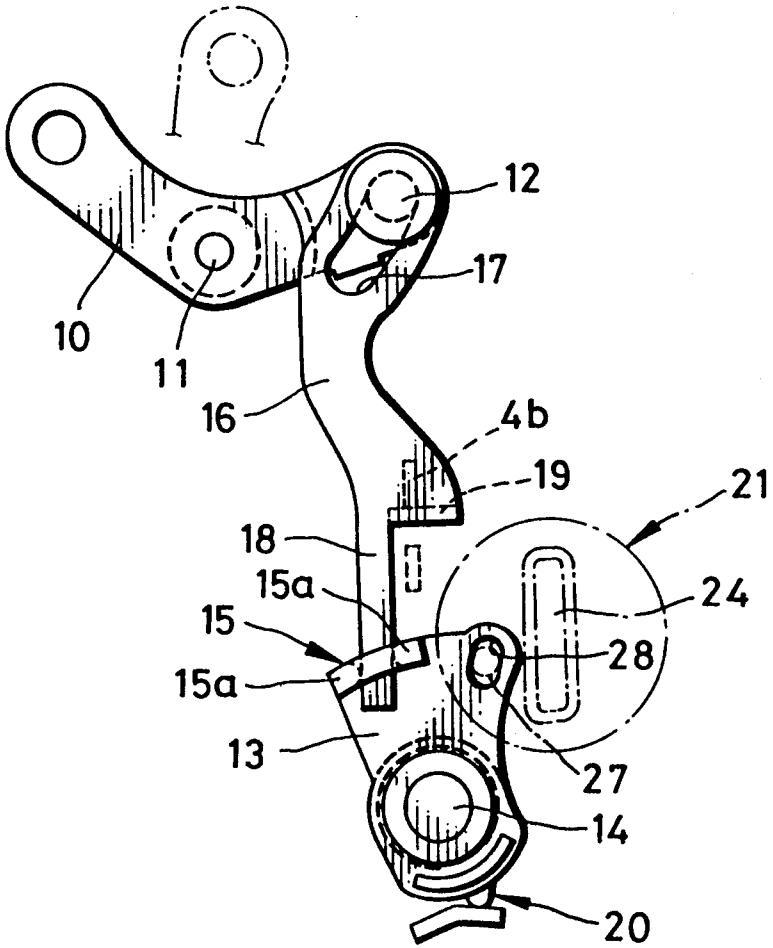
FIGS. 3 through 6 are diagrams for describing the operation of a child protecting mechanism according to the invention.
Figure 3:
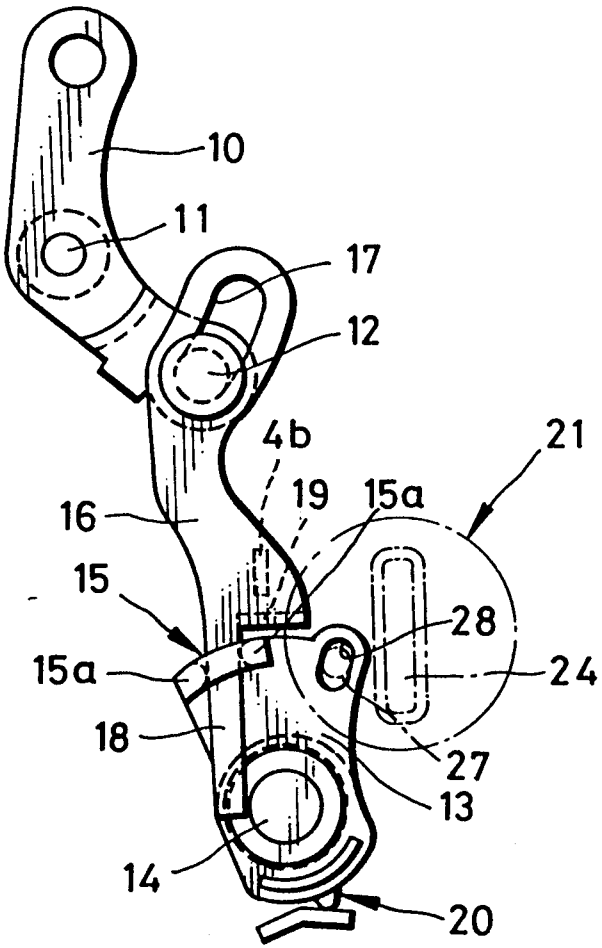
Figure 6:
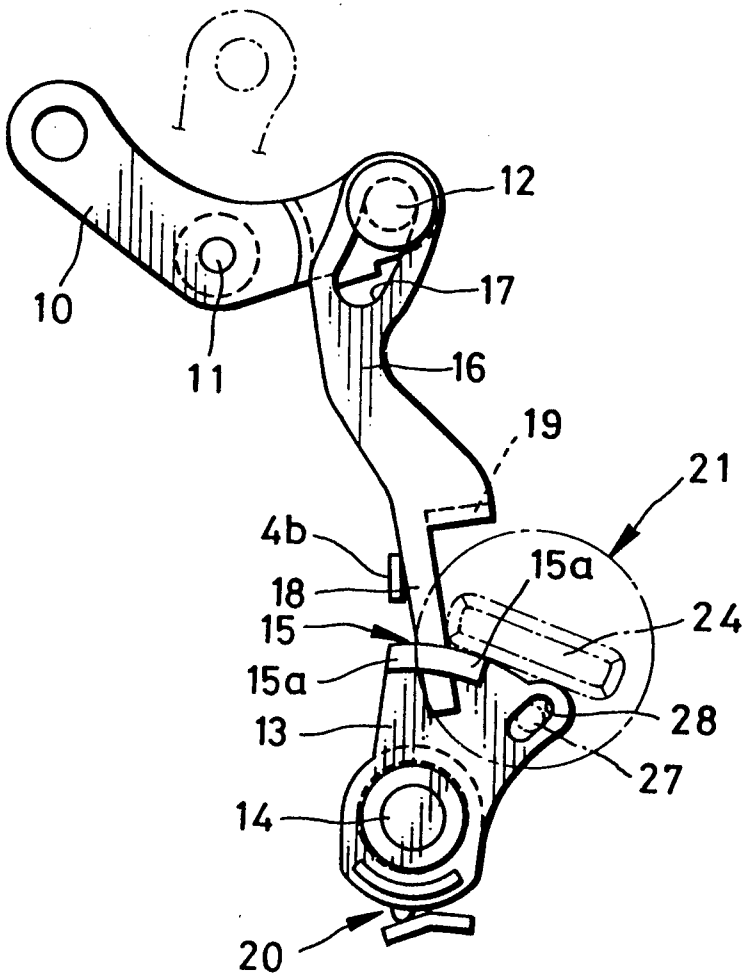

When, in the state shown in FIG. 1, the inside handle is manipulated to turn the inside lever 10 counter-clockwise in FIG. 2, the opening lift lever 16 is shifted from the position indicated by the solid line in FIG. 2 to the position indicated by the two-dot chain line in FIG. 2 (i.e., a transition is made from the state of FIG. 3 to the state of FIG. 4). Owing to this movement of the opening lift lever 16, the engaging portion 19 and the other end 4*b* of the opening lever 4 engage and the opening lever 4 turns counter-clockwise in FIG. 1 against the biasing force of the spring 5. Owing to the turning motion of the opening lever 4, the pin 6*a* of the slide member 6 and the end 2*a* of the lift lever 2 engage, thereby turning the lift lever 2 to actuate the opening/closing mechanism. As a result, the vehicle door (not shown) opens. Further, when the locking knob is operated in the state of FIG. 1 to turn the locking lever 7 counter-clockwise in FIG. 2, the slide member 6 is slid from the position indicated by the solid line in FIG. 1 to the position indicated by the two-dot chain line in FIG. 1 due to engagement between the oblong hole 9 of the locking lever 7 and the pin 6*a* of the slide member 6. Owing to this sliding of the slide member 6, the pin 6*a* of the slide member 6 and the end 2*a* of the lift lever 2 are no longer in an engageable state, or in other words, the locked state is attained in which the turning motion of the opening lever 4 is prevented from being transmitted to the lift lever 2. As a result, the door will not open even if the inside handle is manipulated.

Figure 5:
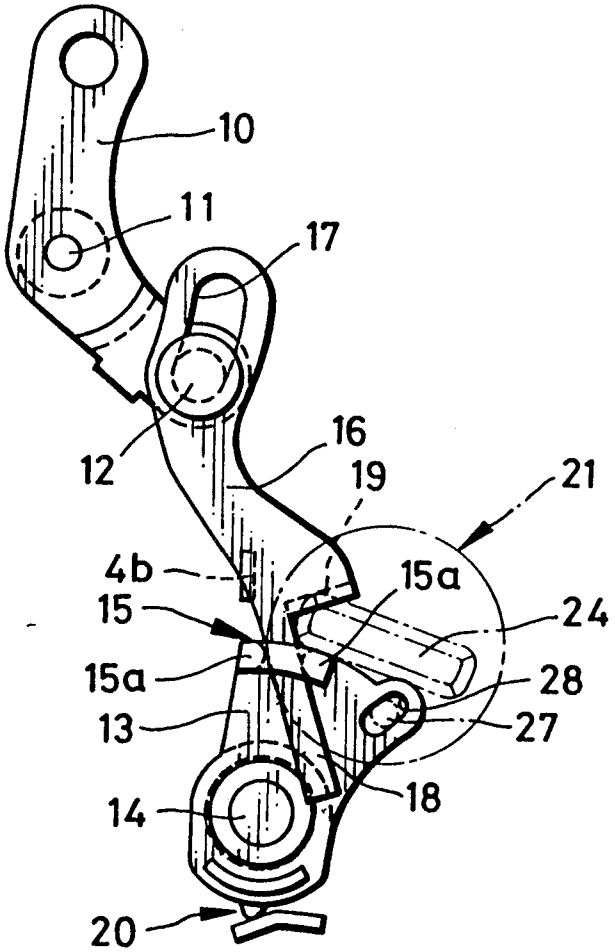

Furthermore, when the child protecting handle 13 is turned clockwise in FIG. 2, the opening lift lever 16 is rocked about the pin 12 from the state of FIG. 3 to the state of FIG. 5. Owing to this rocking motion, the engaging portion 19 of the opening lift lever 16 and the other end 4*b* of the opening lever 4 are no longer in an engageable state, or in other words, the locked state is attained in which the turning motion of the opening lift lever 16 is prevented from being transmitted to the opening lever 4. As a result, even if the inside lever 10 is turned, it performs no meaningful action and the door will not open, irrespective of the state of the locking lever 7.

The operating device will now be described.

Figure 8:
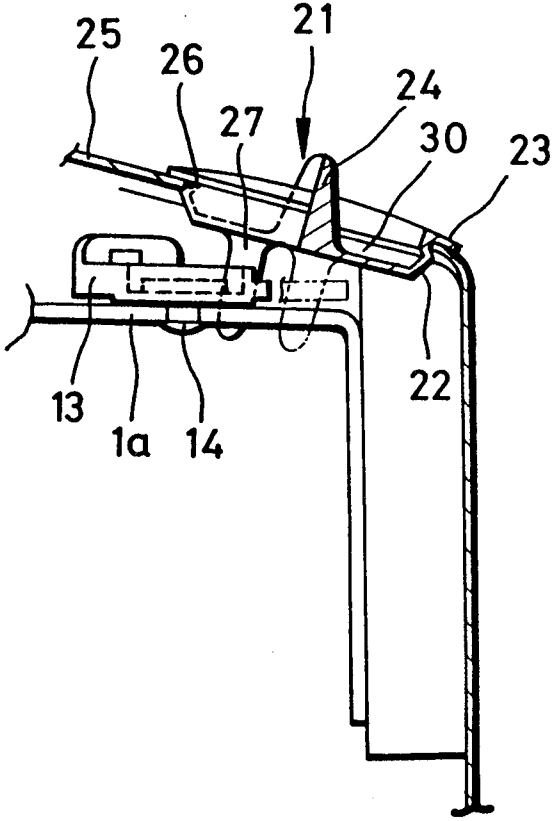
FIG. 8 is a sectional view of the operating device shown in FIG. 7.
Figure 7:
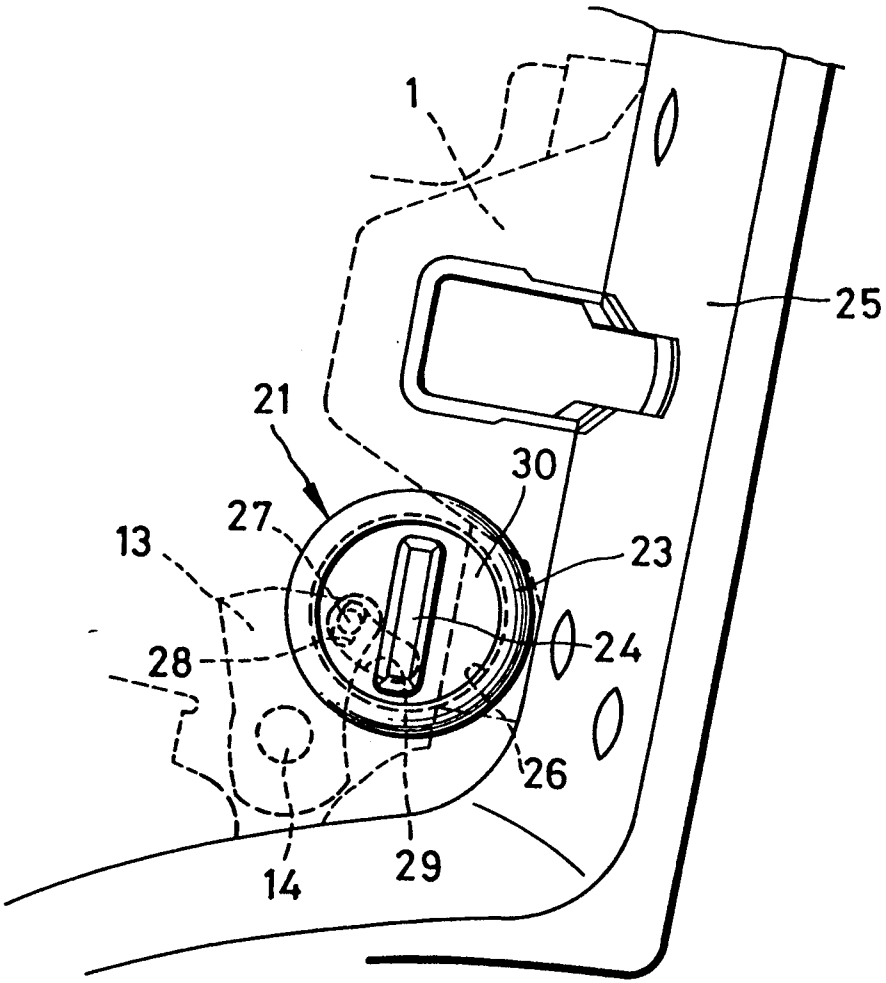
FIG. 7 is a plan view showing an operating device installed door panel of an automotive vehicle.

As shown in FIGS. 7 and 8, an operating device 21 has a circular shape and is constructed by integrally molding a clip portion 22, a lip portion 23 and a knob portion 24. A door panel 25 of an automotive vehicle is formed to have a hole 26 whose center is at a position offset diametrically from the rotational center (pivot pin 14) of the child protecting lever 13. The operating device 21 is rotatably disposed in the hole 26 by fitting the clip portion 22 into the edge of the hole 26 from the outer side. Since the operating device 21 is thus disposed at the position offset diametrically from the rotational center of the child protecting lever 13, selecting the engaging ratio between the child protecting lever 13 and the operating device 21 makes it possible freely select the operating angle of the operating device 21, reduce the operating force and raise decree of freedom in terms of design. The lip portion 23 abuts against the outer surface of the door panel 25 and covers the hole 26 to provide a seal between the door panel 25 and the operating device 21. As a result, water droplets, dust, foul odors and hot or cold air are prevented from penetrating the interior of the passenger compartment, thereby assuring that the occupants will not be troubled by these annoyances. In addition, the interior of the door panel 25 cannot be seen from the hole 26, as a result of which the appearance of the vehicle is improved. A projection 27 is formed on the operating device 21 at a position diametrically offset from its center of rotation. The projection 27 is inserted into and engages with an oblong hole 28, which is formed in the child protecting lever 13 at a position offset from its center of rotation, and is inserted into an oblong guide hole 29 formed in the body 1. The center of the guide hole 29, which serves to guide the projection 27, is the center of rotation of the operating device 21. As a result of this arrangement, turning the operating device 21 counter-clockwise in FIG. 7 causes the child protecting lever 13 to turn from the state shown in FIG. 3 to the state shown in FIG. 5 via the engagement between the projection 27 and the oblong hole 28. The operating device 21 thus acts as described above. The operating device 21 is further formed to include a recess 30. This allows the operating device 21 to be readily deformed when it is installed, thereby making it easy to fit the operating device 21 into the hole 26.

A first modification of the operating device 21 will be described with reference to FIGS. 9 and 10.

Figure 10:
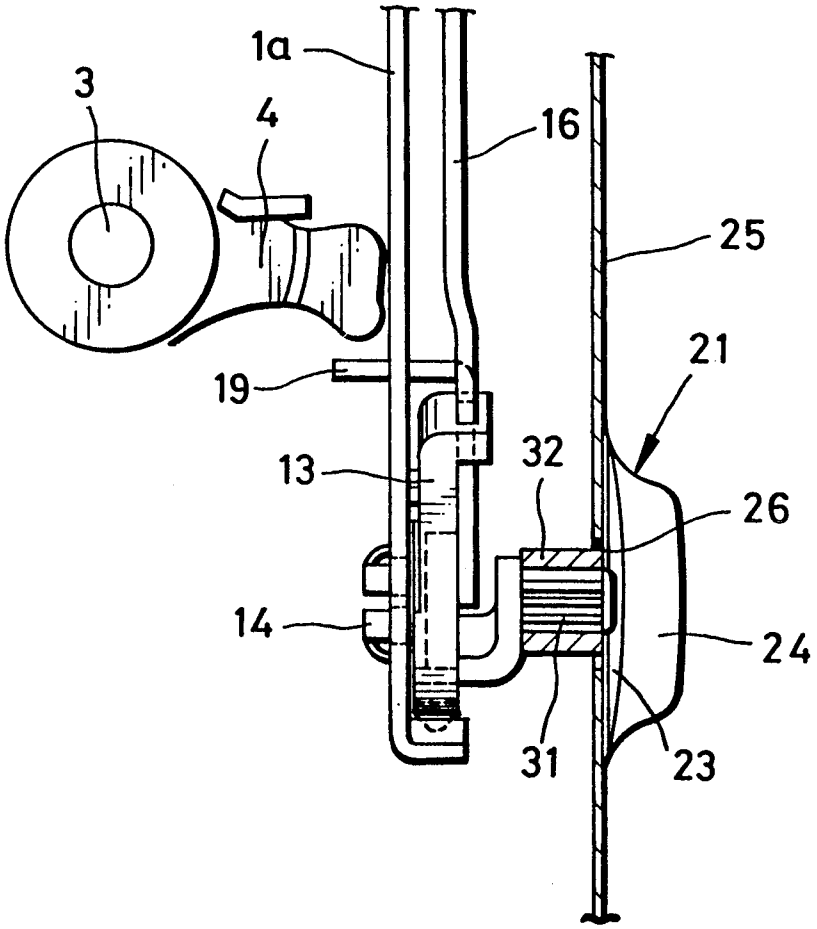
FIG. 10 is a sectional view corresponding to FIG. 8 and showing the first modification of the operating device.
Figure 9:
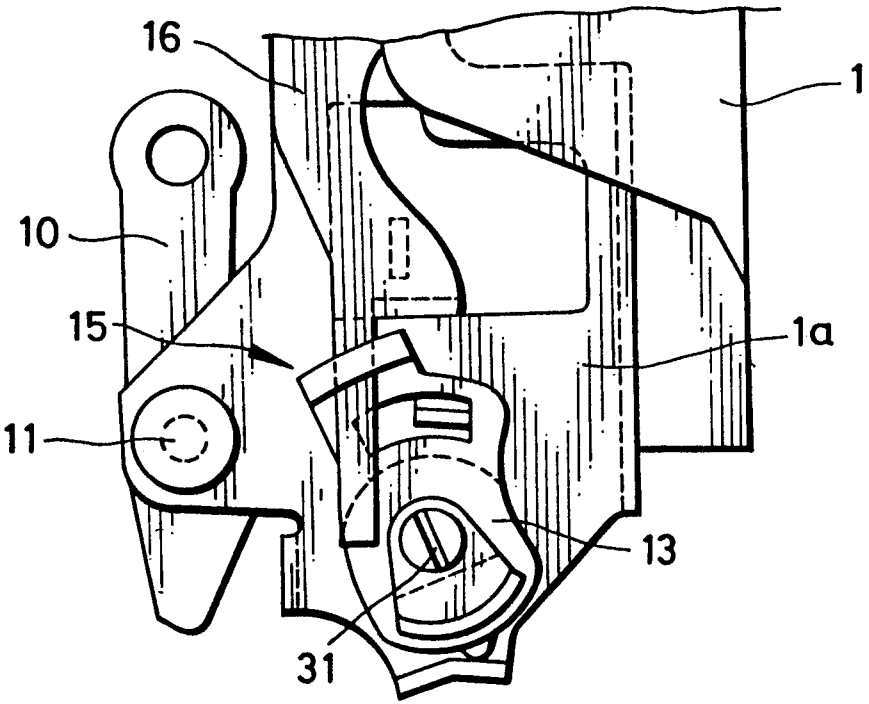
FIG. 9 is a plan view showing a first modification of the device.

As shown in FIGS. 9 and 10, the child protecting lever 13 is formed to include a shaft 31 coaxial with the pivot pin 14. A bearing portion 32 formed on the operating device 21 is inserted into the hole 26 provided in the door panel 25 in coaxial relation with respect to the pivot pin 14 and shaft 31, as a result of which the bearing portion 32 is integrally fitted into the hole 26. The operating device 21 is thus arranged on the child protecting lever 13 with the door panel 25 being embraced thereby. Since the operating device 21 is thus fitted into the child protecting lever 13, the device is not affected by the dimensional precision of the hole 26. In addition, since the operating device 21 and the child protecting lever 13 are linked solely by the shaft 31, the number of component parts can be reduced, assembly is facilitated and operability is enhanced because there is little play or backlash. It should be noted that the shaft 31 can be integrated with pivot pin 14, in which case the pivot pin would co-rotate with child protecting lever 13 when the latter is turned.

A second modification of the operating device 21 will now be described with reference to FIG. 11.

Figure 11:
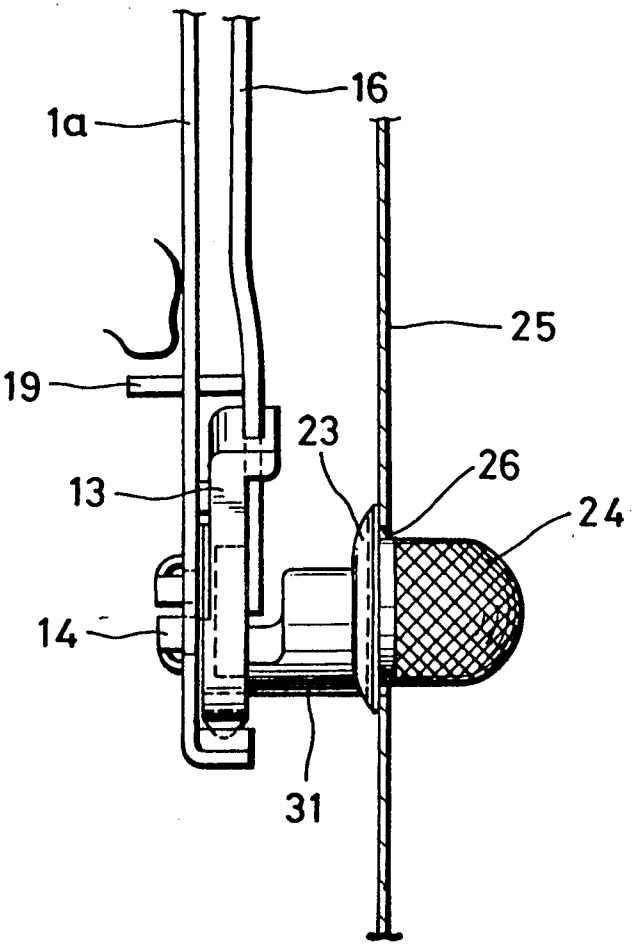
FIG. 11 is a sectional view corresponding to FIG. 8 and showing a second modification of the operating device.

As shown in FIG. 11, the shaft 31 and the operating device 21 are integrated, the shaft 31 is formed to have the lip portion 23 which abuts against the inner surface of the door panel 25, and the shaft 31 protrudes from the hole 26 to form the knob portion 24. This arrangement makes it possible to reduce the number of component parts and to facilitate assembly.

Figure 12:
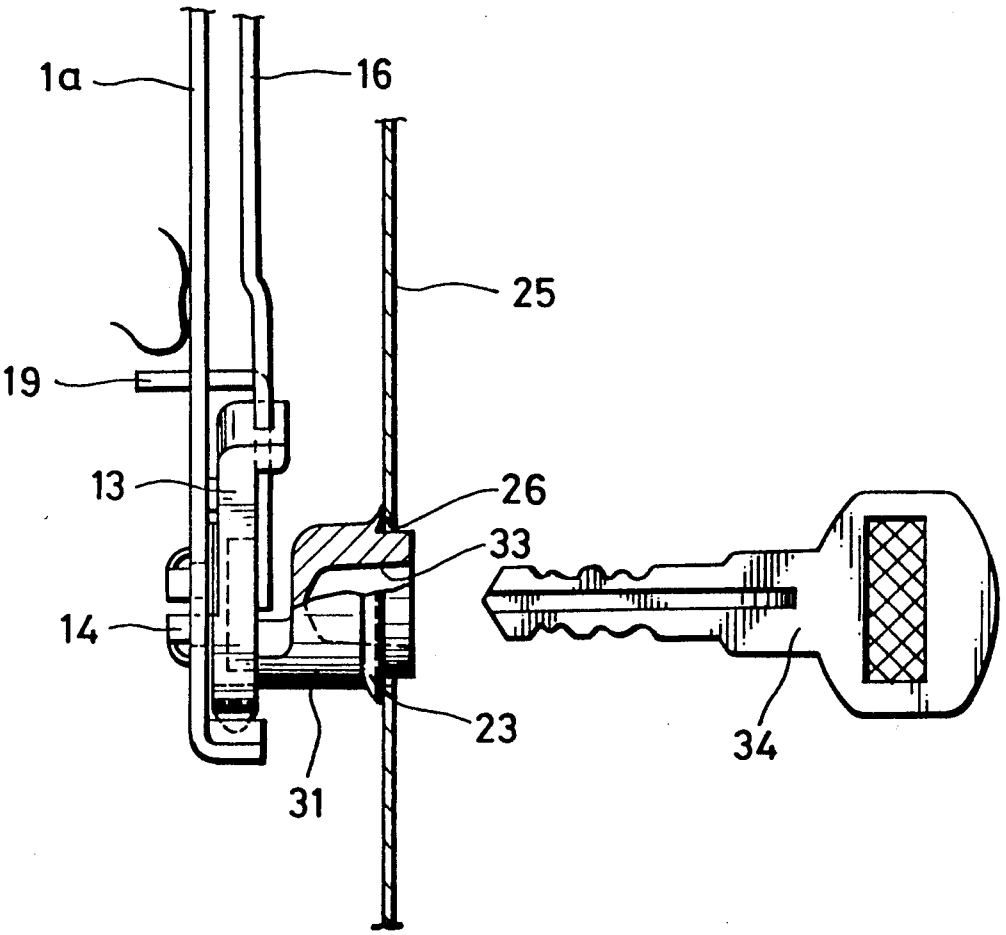
FIG. 12 is a sectional view corresponding to FIG. 8 and showing a third modification of the operating device.

In a third modification of the operating device 21 shown in FIG. 12, the knob 24 is dispensed with and the shaft 31 is formed to have a recess 33. Since the amount by which the device protrudes from the door panel 25 is reduced in this modification, safety is enhanced and a washing tool such as a mop will not catch on the protrusion when the vehicle is washed. Furthermore, by adapting the recess 33 to serve as a keyhole and adopting an arrangement in which the device is manipulated by a key, the device can be made tamper-proof.

Thus, the child protecting mechanism for a door lock apparatus installed in a door panel has an operating device disposed in an opening formed in the door panel, and the operating device is operatively linked with a child protecting lever and adapted to be rotated with respect to the door panel to operate the child protecting lever. Such a structure is advantageous in that the opening need not be provided with space for allowing movement of the operating device, and the opening can be sealed to prevent water droplets, dust, foul odors and cold or hot air from penetrating the interior of the passenger compartment by passing through the opening. As a result, the occupants of the passenger compartment do not experience discomfort from these annoyances. In addition, since the interior of the door panel cannot be seen from the opening, the appearance of the vehicle is improved.

As many apparently widely different embodiments of the present invention can be made without departing from the spirit and scope thereof, it is to be understood that the invention is not limited to the specific embodiments thereof except as defined in the appended claims.

What is claimed is:

1. A child protecting mechanism in a door lock apparatus provided in a door panel having an opening, comprising:

a child protecting lever, and operating means rotatably disposed in the opening in operative association with said child protecting lever for operating said child protecting lever by being rotated relative to the door panel, the operating means having an outer periphery including a lip portion, said lip portion abutting the door panel adjacent the opening for covering the opening.

2. The mechanism according to claim 1, wherein said child protecting lever has a center of rotation, and said operating means is disposed at position diametrically offset from the center of rotation of said child protecting lever.

3. The mechanism according to claim 1, wherein said child protecting lever has a center of rotation, and said operating means is disposed coaxially with respect to the center of rotation of said child protecting lever.

4. The mechanism according to claim 1 wherein said operating means is formed integral with said child protecting lever.

5. The mechanism according to claim 1 wherein said operating means is formed to include a clip portion fitted into the opening in engagement with an edge of the opening; and a manipulation portion for manipulating said operating means.

6. The mechanism according to claim 5, wherein said manipulating portion is a recess.

* * * * *